United States Patent [19]

Dreier

[11] 4,359,954

[45] Nov. 23, 1982

[54] SKIPPED-STITCH MECHANISM ON A SEWING MACHINE

[75] Inventor: Ernst Dreier, Steckborn, Switzerland

[73] Assignee: Fritz Gegauf Aktiengesellschaft Bernina-Nähmaschinenfabrik, Steckborn, Switzerland

[21] Appl. No.: 167,102

[22] Filed: Jul. 9, 1980

[30] Foreign Application Priority Data

Jul. 17, 1979 [CH] Switzerland ..... 6621/79

[51] Int. Cl.[3] ..... D05B 3/02; D05B 69/30

[52] U.S. Cl. ..... 112/221

[58] Field of Search ..... 112/221, 158 R, 158 A, 112/158 B, 158 C, 158 D, 220, 271, 274

[56] References Cited

U.S. PATENT DOCUMENTS 3,433,189 3/1969 Weisz ..... 112/221 X 3,433,190 3/1969 Sagi ..... 112/221

*Primary Examiner*—Peter P. Nerbun

*Attorney, Agent, or Firm*—Birch, Stewart, Kolasch & Birch

[57] ABSTRACT

The present invention is directed to a skipped-stitch mechanism on a sewing machine having a needle bar oscillating in a longitudinal direction, a control device for producing lateral swing-out motions of the needle bar in order to make different zigzag stitches, and a coupling device coacting with the needle bar and operated by a second control device so as to intermittently separate the needle bar from its driving member under the control of a program device in order to skip the stitching.

9 Claims, 3 Drawing Figures

SKIPPED-STITCH MECHANISM ON A SEWING MACHINE

BACKGROUND AND SUMMARY OF THE INVENTION

The present invention is directed to a skipped-stitch mechanism on a sewing machine having a needle bar oscillating in a longitudinal direction, a control device for producing lateral swing-out motions of the needle bar in order to make different zigzag stitches, and a coupling device coacting with the needle bar and operated by a second control device so as to intermittently separate the needle bar from its driving member under the control of a program device in order to skip the stitching.

Skip-stitch mechanisms are well known in the art. One embodiment is exemplified by West German Pat. No. 1,683,029. The coupling member is a horizontally-disposed swiveling lever which, in order to couple the needle bar with the driver, engages in a slot in the needle bar when the latter is in a given lateral swing position (zigzag stitch). The appropriate locking of the needle bar is effected through friction. Aside from the fact that the coupling slot weakens the needle bar, this mechanism has the considerable drawback that during the lifter motion of the needle bar the disengaged coupling lever wipes over the control arm and the friction pad provided for the locking of the bar exerts a continuous braking action. Another drawback is the release of the coupling on only one side of the swinging motion of the needle.

Therefore, an object of the present invention is to provide a skipped-stitch mechanism of the type referred to above which, independently of the swing-out position of the needle bar, enables the release of the positive coupling of the needle bar with the driver and simultaneously produces a positive locking of the disengaged needle bar in its upper final position. To this end, the skipped-stitch mechanism according to the present invention is characterized in that the coupling device is provided with a spring-loaded bolt positioned on the needle bar drive and engaged in a hole in the needle bar. The bolt is in operable engagement with a disengaging lever which, independently of the lateral position of the needle bar in the upper section of its path of motion, is operated by a program-controlled control lever in the direction of disengagement of the needle bar. The control lever acts simultaneously in its position of disengagement on a pawl provided for the disengaged needle bar and placed on the housing of the sewing machine in order to hold the needle bar in its upper final position.

It is essential that the disengagement occur immediately independently of the lateral position of the needle bar, which changes during the zigzag stitching. The spring-loaded bolt on the needle bar driver with a disengaging lever constitutes only a slight mass which is to be moved along with the needle bar, and a special advantage resides in the fact that the disengaged needle bar is constrained, that is to say, is positively held in its upper final position by a pawl and not, for example, through friction. It should also be recognized that a radial bore in the needle bar, which enables the pin to be engaged, does not weaken the needle bar nearly as much as a radial slot as utilized in the prior art.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 2:
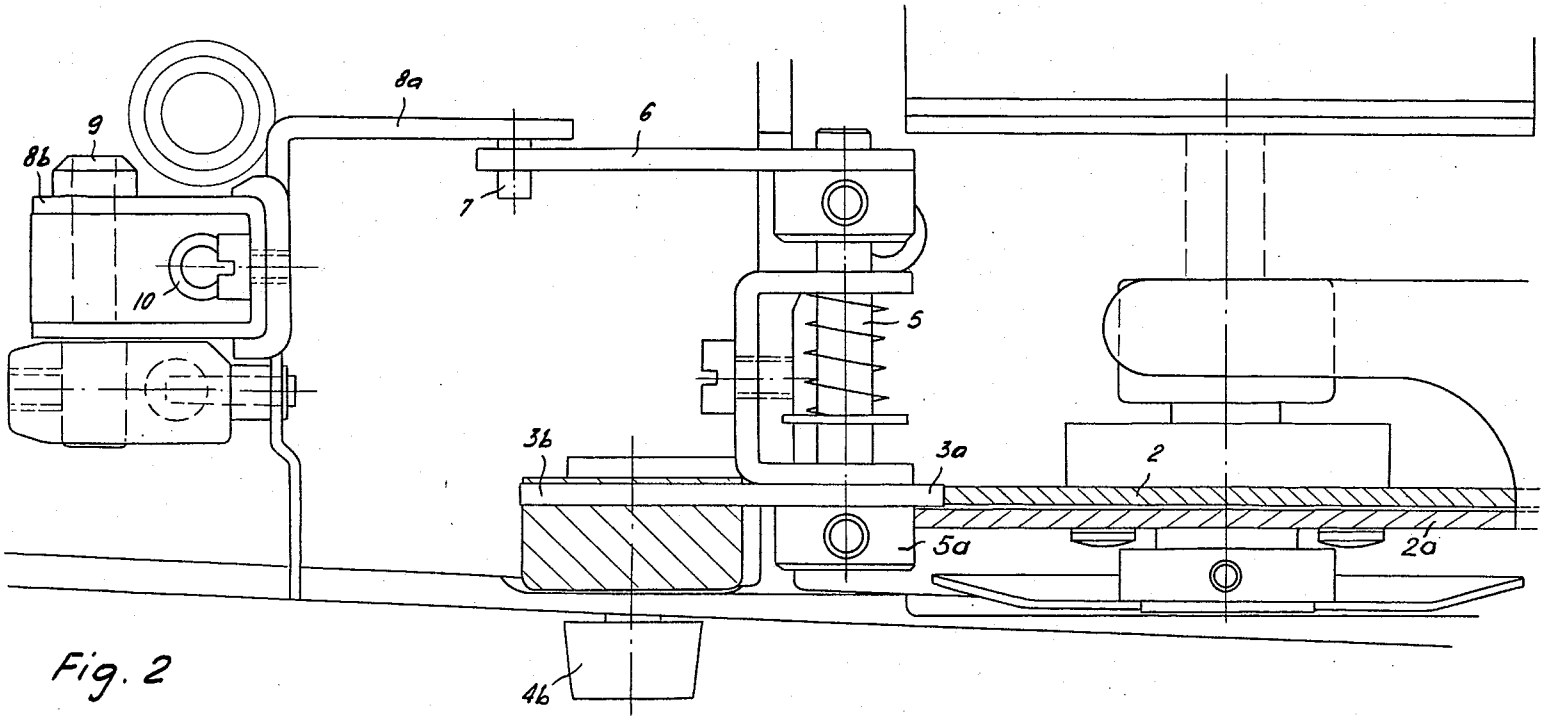
FIG. 2 is a plan view of FIG. 1.

In the housing of the sewing machine there is arranged, with a horizontal axis of rotation, a program cam plate 2, with a peripheral surface corresponding to the control program for the stitch skipping. The peripheral surface is traced by sensing arm 3*a* of the double-armed lever. The other arm 3*b* of this spring-loaded lever coacts with a cam 4*a* which, by means of a control knob 4*b*, can bring the sensing arm 3*a* in or out of engagement with the program cam plate 2 in order to engage or disengage the skipped-stitch mechanism. A guide 6 is attached to the swiveling shaft 5 of the double-armed lever 3*a*, 3*b*. The guide 6 is operatively connected with one arm 8*a* of a double-armed control lever 8*a*, 8*b*. The control lever 8*a*, 8*b* swings around an axis 9 and can follow each lateral position of the needle bar 10 via mechanical or electromechanical means not shown in detail. This is appropriately accomplished by means of the zigzag control device. As shown in FIG. 2, at least one more program cam plate 2*a* may be provided with another peripheral surface utilizing a knob 5*a* on the shaft 5 which is spring-loaded in an axial direction, or alternatively, the double-armed lever 3*a*, 3*b* can be operatively connected with either the program cam plate 2 or 2*a*.

The free end of the control lever arm 8*b* projecting downward in the area of the needle bar 10 carries a control roll 11 which is designed to coact with a disengaging lever 12 having a lifting flank 12*a* for the control roll 11. The disengaging lever 12 is swivel-mounted on a cylinder 14 arranged in the needle bar driver 13 in an axial plane through the needle bar 10 and reaches with a lug through a slot of the cylinder 14 into a recess 15*a* of a piston 15 carried in a cylinder 14. The hollow piston 15 has a coupling pin 15*b* at the end thereof turned toward the needle bar 10. The coupling pin 15*b* is designed to engage a matching radial hole 10*a* in the needle bar 10. Advantageously, this pin has a conical configuration in order to ensure clearance-free coupling with the needle bar 10. The piston 15 is loaded in the direction of the coupling engagement with the needle bar 10 by means of a spring 16 supported on the cylinder cover 14*a*. Furthermore, a double-armed pawl 17 is swivel-mounted in the upper section of the machine frame 1 and is loaded by a spring 18 in the direction of its catch position in which the lower pawl arm 17*a* can fall into a notch 19 provided on the needle bar 10, while a disengaging pin 20 provided on the control lever arm 8*b* can coact with the upper pawl arm 17*b*.

Figure 1:
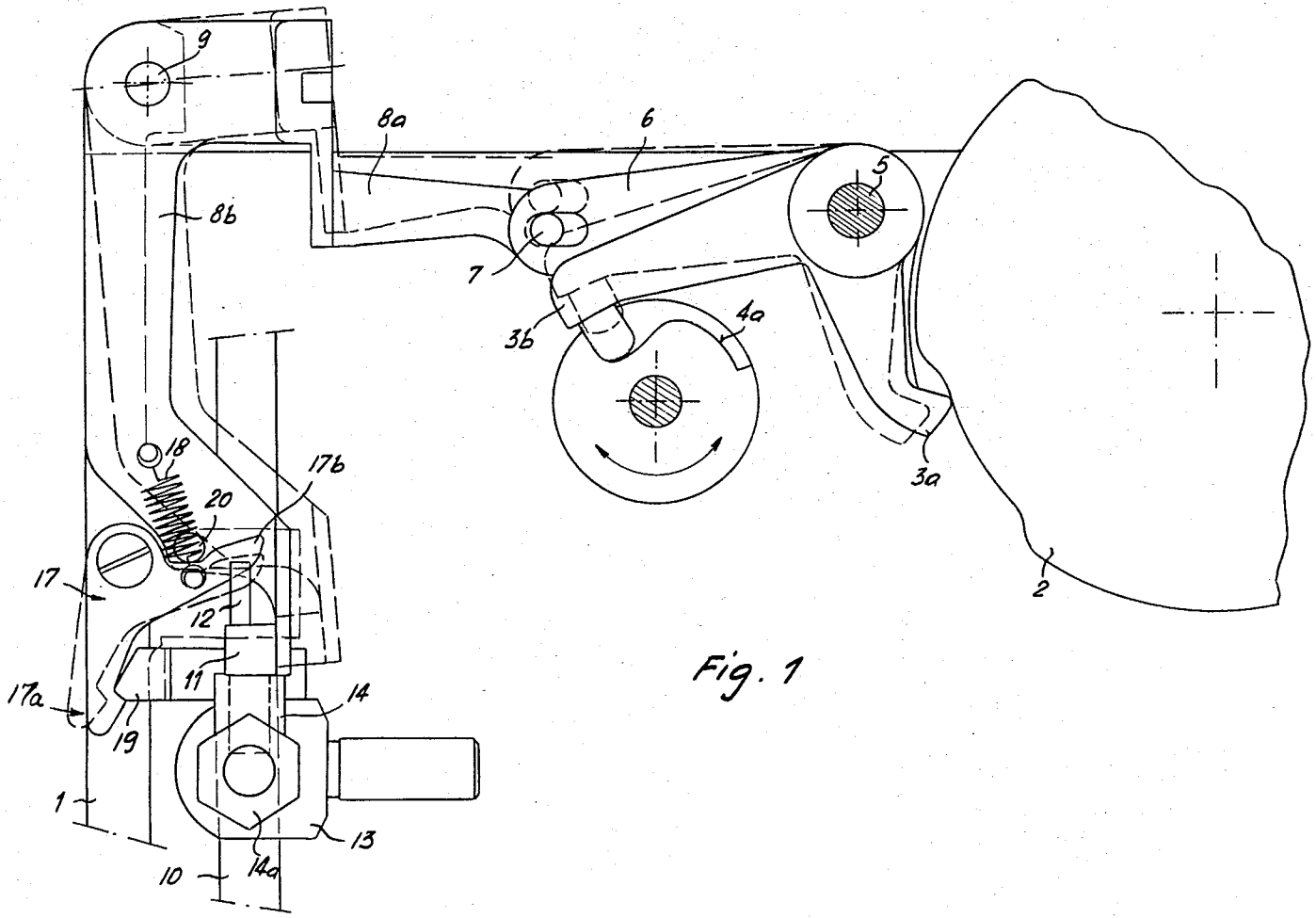
FIG. 1 is a side view of the mechanism with the coupling and control devices.
Figure 3:
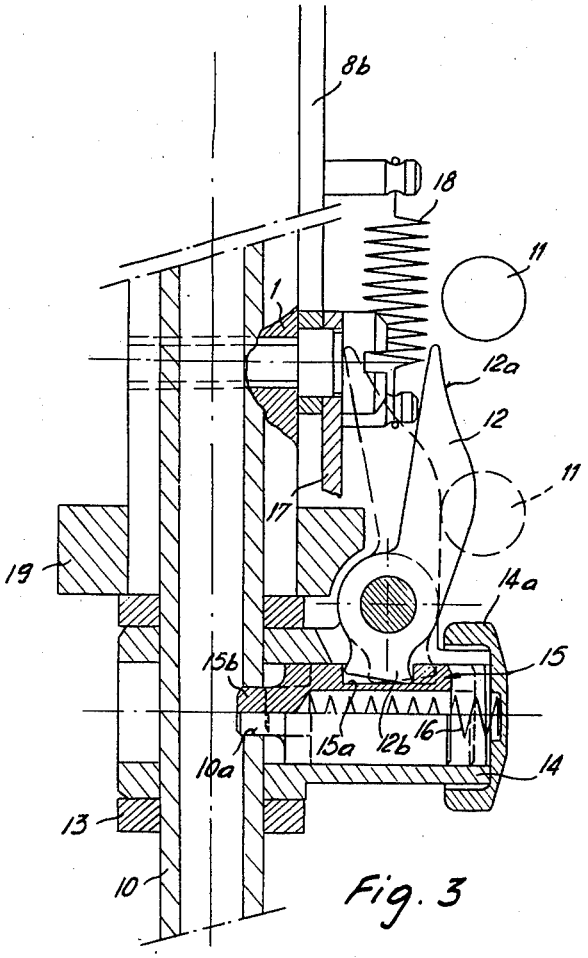
FIG. 3 shows the coupling device on a larger scale and in an axial section perpendicular to the plane of the drawing in FIG. 1.

The operation of the skipped-stitch mechanism can be described as follows:

If the initial position is that of the individual elements shown in FIG. 1, in which the double-armed lever 3*a*, 3b is in the position of engagement by means of the cam 4a, the sensing arm 3a follows the peripheral depression of the program cam plate 2 which corresponds to the release of the needle bar 10. This leads to the swiveled position of the control lever 8a, 8b indicated by the solid lines in FIG. 1 in which the control roll 11 projects into the path of motion of the disengaging lever 12 coupled with the needle driver 13. Consequently, during the upward motion of the driver 13 and, thereby, of the needle 10 coupled therewith through the spring-loaded piston 15, the lifting flank 12a of the disengaging lever moves against the control roll 11 so that this disengaging lever is swiveled to the position indicated by the broken lines in FIG. 3. Lug 12b of the disengaging lever 12 presses the piston 15 with its pin 15b against the action of the spring 16 out of engagement with the needle bar 10, thereby releasing the latter. Since in this position of the control lever 8a, 8b the pawl 17 is into engagement with the pin 20 by means of the spring 18 to the catch position indicated by the solid lines in FIG. 1, the notch 19 engages the lower pawl area 17a during the upward movement of the needle bar and practically, simultaneously with the release of the latter, and the needle bar 10 remains positively locked in its upper final position. Thus, during this section of the program (represented in FIG. 1 by the depressed cam section of the program cam plate 2) no stitching takes place. As the program cam plate 2 rotates further, the sensing arm 3a moves against the higher area of the peripheral surface of the cam plate 2, and the double-armed lever 3a, 3b and, thereby, the guide 6, are swiveled accordingly (in clockwise direction in FIG. 1). This causes the control lever 8a, 8b to be swiveled to the position indicated by the dotted lines in FIG. 1. In this way, not only is control roll 11 moved out of the path of motion of the disengaging lever 12 but also the bolt 20 presses through arm 17b of pawl 17, the catch arm 17a out of its engagement with notch 19 of the needle bar 10. When the driver 13, which carries the now-released disengaging lever 12, with the spring-loaded pin 15b is flush with hole 10a of the released needle bar 10, the driver 13 is positively coupled with the needle bar 10. If the skipped-stitch mechanism is to be switched off, the lever arm 3b is lifted to the higher section of the cam 4a by means of the control knob 4b, thereby preventing the sensing arm 3a from sinking into the depressed portion of the program cam plate 2, which causes the release of the needle bar.

Thus, in summary, the skipped-stitch mechanism is controlled by means of a program cam plate 2 via levers 3a, 6, 8a and 6b. It has a coupling device which, by means of a control lever 8a, 8b can be engaged with and released from the needle bar 10 independently of the lateral swing-out position of the latter. The coupling device has a spring-loaded piston pin 15 carried on the driver 13 and has a coupling pin 15b which engages in a hole 10a of the needle bar. A disengaging lever 12 arranged on the driver engages with a lug 12b in a recess 15a of the piston pin 15. The disengaging lever 12 coacts with a control roll 11 of the control lever 8a, 8b. In the skipped-stitch position of the control lever defined by the program, the control roll 11 thereof presses the disengaging lever 12 and, thereby, the coupling pin 15b out of its engagement with the needle bar 10. The needle bar 10 is simultaneously locked in its upper final position by a pawl 17. The locking is cancelled out when the control lever 8a, 8b is swiveled back to the position which enables the driver to be coupled with the needle bar.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A skipped-stitch mechanism for a sewing machine comprising:

a needle bar connected to a needle bar driver and containing a radial aperture therein, said needle bar being adapted to oscillate in a longitudinal direction, a first control device for producing lateral swing-out motions of the needle bar in order to make different zigzag stitches, a coupling device coacting with the needle bar, and a second control device for operating the coupling device so as to intermittently separate the needle bar from its driving member under the control of a program device, in order to skip the stitching, said coupling device including a radially movable spring-biased bolt positioned on the needle bar driver and engaging the radial aperture in the needle bar, a disengaging lever operatively associated with said radially movable spring-biased bolt and operated independently of the lateral position of the needle bar in the upper section of its path of motion by a program-controlled control lever in a direction of disengagement of the needle bar, and a pawl member provided for the disengaged needle bar and placed on the housing of the sewing machine so as to positively hold the needle bar in its upper final position, said control lever acting simultaneously in its position of disengagement on said pawl member.

2. The skipped-stitch mechanism of claim 1 wherein the radially movable spring-biased bolt is a trunk piston carried in a cylinder placed on the needle bar driver and provided with a pin which fits in the radial aperture in the needle bar.

3. The skipped-stitch mechanism of claim 2 wherein the disengaging lever contains a lug which engages in a recess provided in the trunk piston, said disengaging lever being swivel-mounted on the cylinder and provided with a lifting flank surface which cooperates with a control roll provided on the control lever.

4. The skipped-stitch mechanism of claim 3 wherein mechanical or electromechanical adjusting means are provided to move the control lever in any lateral position of the needle bar into the path of motion of the disengaging lever.

5. The skipped-stitch mechanism of claim 4 wherein the control lever is a double-armed lever which is swivel-mounted with the arms being substantially perpendicular to each other, one arm being operatively connected through a guide means with a sensing lever which traces a program cam plate, and the other arm carrying at its lower end the control roll acting on the lifting flank surface of the disengaging lever.

6. The skipped-stitch mechanism of claim 3 wherein the pin of the trunk piston has a conical configuration so as to ensure clearance-free engagement in the radial aperture of the needle bar.

7. The skipped-stitch mechanism of claim 5 wherein control knob means are provided for lifting the sensing lever from the program cam plate to switch off the mechanism.

8. The skipped-stitch mechanism according to claim 1, wherein said pawl member is a double armed pawl including a lower pawl portion adapted to engage a notch operatively connected to said needle bar to retain said needle bar in its upper final position.

9. The skipped-stitch mechanism according to claim 8, wherein said pawl member includes an upper pawl arm being normally spring biased into engagement with a pin for normally positioning said lower pawl portion in operative engagement with said notch.

* * * * *